US006608270B2

(12) United States Patent
Donofrio et al.

(10) Patent No.: US 6,608,270 B2
(45) Date of Patent: Aug. 19, 2003

(54) FLEXIBLE SWITCH MEMBERS FOR HAND ACTIVATION HANDPIECE SWITCHES

(75) Inventors: William T. Donofrio, Cincinnati, OH (US); Robert P. Gill, Mason, OH (US)

(73) Assignee: Ethicon Endo-Surgery, Inc., Cincinnati, OH (US)

( * ) Notice: Subject to any disclaimer, the term of this patent is extended or adjusted under 35 U.S.C. 154(b) by 14 days.

(21) Appl. No.: 09/874,556

(22) Filed: Jun. 4, 2001

(65) Prior Publication Data

US 2002/0046938 A1 Apr. 25, 2002

Related U.S. Application Data

(60) Provisional application No. 60/241,889, filed on Oct. 20, 2000, and provisional application No. 60/242,272, filed on Oct. 20, 2000.

(51) Int. Cl.[7] ..... H01H 9/04; H01H 19/04; H01H 1/00

(52) U.S. Cl. ..... 200/302.1; 200/302.3

(58) Field of Search ..... 200/5 A, 306, 200/302.1–302.3, 512–517; 174/250–268

(56) References Cited

U.S. PATENT DOCUMENTS

| | | | | | |
|---|---|---|---|---|---|
| 2,917,691 | A | | 12/1959 | DePrisco et al. | 318/118 |
| 3,790,734 | A | * | 2/1974 | Raab et al. | 200/302.2 |
| 3,808,389 | A | * | 4/1974 | Ramsay et al. | 200/302.2 X |
| 4,074,088 | A | * | 2/1978 | Keough et al. | 200/5 A |
| 4,947,461 | A | * | 8/1990 | Yoshioka et al. | 200/5 R |
| 5,001,649 | A | | 3/1991 | Lo et al. | 364/484 |
| 5,026,387 | A | | 6/1991 | Thomas | 606/169 |
| 5,112,300 | A | | 5/1992 | Ureche | 604/22 |
| 5,180,363 | A | | 1/1993 | Idemoto et al. | 202/32 |
| 5,400,267 | A | | 3/1995 | Denen et al. | 364/552 |
| 5,425,704 | A | | 6/1995 | Sakurai et al. | 604/22 |
| 5,449,370 | A | | 9/1995 | Vaitekunas | 606/169 |
| 5,630,420 | A | | 5/1997 | Vaitekunas | 128/662.03 |
| 5,707,369 | A | | 1/1998 | Vaitekunas et al. | 606/31 |
| 5,879,364 | A | | 3/1999 | Bromfield et al. | 606/169 |
| 5,957,272 | A | * | 9/1999 | Kim | 200/302.2 X |
| 5,968,007 | A | | 10/1999 | Simon et al. | 604/22 |
| 5,990,431 | A | * | 11/1999 | Wright | 200/302.3 |
| 6,011,226 | A | * | 1/2000 | Sadowski et al. | 200/302.3 |
| 6,017,354 | A | | 1/2000 | Culp et al. | 606/170 |
| 6,019,775 | A | | 2/2000 | Sakurai | 606/169 |
| 6,066,135 | A | | 5/2000 | Honda | 606/39 |
| 6,090,123 | A | | 7/2000 | Culp et al. | 606/180 |
| 6,444,930 | B1 | * | 9/2002 | MacDonald et al. | 200/302.3 |

FOREIGN PATENT DOCUMENTS

| | | | |
|---|---|---|---|
| JP | 2000-175926 | 6/2000 | A61B/17/22 |

* cited by examiner

*Primary Examiner*—J. R. Scott
(74) *Attorney, Agent, or Firm*—Darby & Darby

(57) ABSTRACT

Methods of controlling fluid flow (e.g., flow of liquids, water vapor and gases) through switch members, e.g., switch buttons, which are used to seal an interior cavity of a surgical handpiece are provided. The switch members provide improved sealing properties which prevent gas and water vapor transmission across the switch member and into and out of the sealed internal switch chamber. The switch members are also resistant to puncture due to striking by tools or cleaning instruments, or the like.

42 Claims, 11 Drawing Sheets

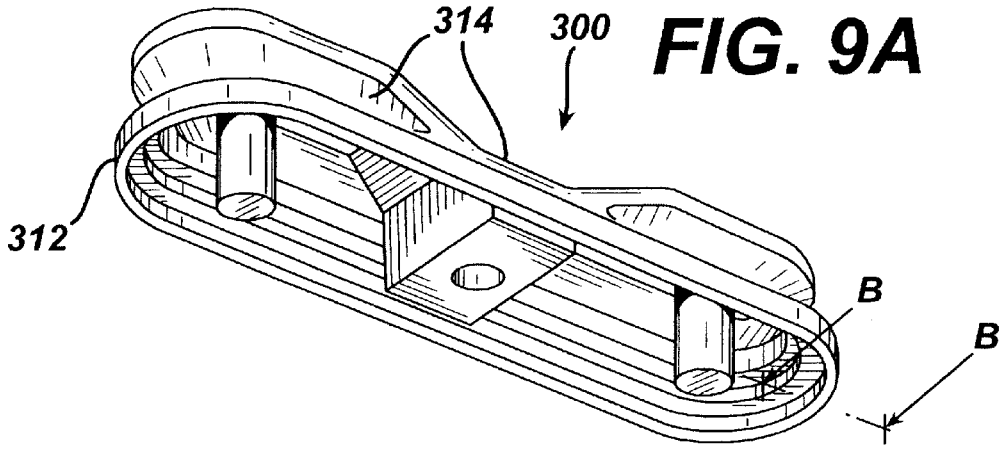
FIG. 9A
FIG. 9B
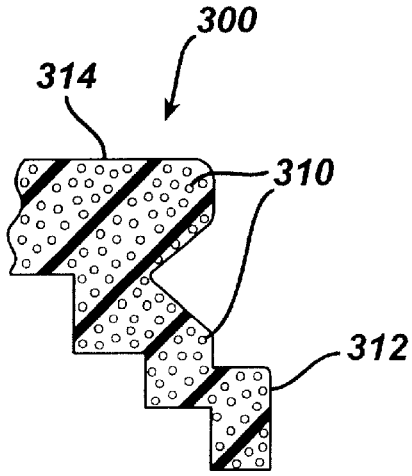
FIG. 10
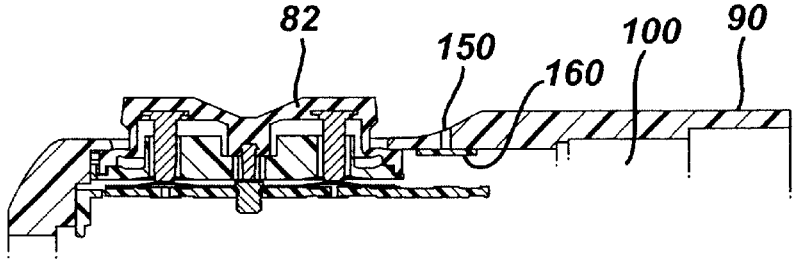

FLEXIBLE SWITCH MEMBERS FOR HAND ACTIVATION HANDPIECE SWITCHES

CROSS REFERENCE TO RELATED APPLICATIONS

This application claims the benefit of U.S. patent application Ser. No. 60/242,272, filed Oct. 20, 2000 and entitled "Flexible Membranes for Hand Activation Handpiece Switches" and U.S. patent application Ser. No. 60/241,889, filed Oct. 20, 2000 and entitled "Detention Circuitry for Surgical Handpiece System", both of which are incorporated herein by reference in their entirety.

BACKGROUND OF THE INVENTION

This application relates to ultrasonic surgical systems and, more particularly, to switch members having membrane seals which prevent gas and water vapor from contacting switch assemblies which are disposed within an internal switch chamber formed in a surgical handpiece.

It is known that electric scalpels and lasers can be used as surgical instruments to perform the dual function of simultaneously effecting the incision and hemostatis of soft tissue by cauterizing tissues and blood vessels. However, such instruments employ very high temperatures to achieve coagulation, causing vaporization and fumes as well as splattering. Additionally, the use of such instruments often results in relatively wide zones of thermal tissue damage.

Cutting and cauterizing of tissue by means of surgical instruments, e.g., blades, vibrated at high speeds by ultrasonic drive mechanisms is also known. In such systems, an ultrasonic generator is provided which produces an electrical signal of a particular voltage, current and frequency, e.g., 55,500 cycles per second. The generator is connected by a cable to a handpiece, which contains piezoceramic elements forming an ultrasonic transducer. In response to a switch on the handpiece or a foot switch connected to the generator by another cable, the generator signal is applied to the transducer, which causes a longitudinal vibration of its elements. A structure connects the transducer to a surgical blade, which is thus vibrated at ultrasonic frequencies when the generator signal is applied to the transducer. The structure is designed to resonate at the selected frequency, thus amplifying the motion initiated by the transducer.

In order to activate the handpiece so that the blade is vibrated or otherwise operated, a switch mechanism is manipulated by the user. The switch mechanism typically includes one or more switch button members which the user depresses to cause activation of the blade. Because it is necessary for the handpiece to be cleaned and/or serviced after use, the internal electronic components of the switch mechanism must be sealed from the environment outside of the handpiece to prevent damage to the electronic components during the cleaning, use, handling, or servicing thereof. This is particularly true for handpieces which are autoclavable and/or immersible. Consequently, a membrane (e.g., a flexible seal) may be included as part of the switch member for sealing the electronic components of the switch mechanism so that the handpiece may be cleaned and/or serviced without having the electronic components damaged.

Typically, the switch member (having button portions) is formed of a resilient material, such as an elastomeric material, to provide a sealing action between the switch member and the handpiece. Elastomeric switch buttons are generally not good barriers to moisture ingress (water vapor), especially moisture ingress due to an autoclave operation. Elastomeric materials are vulnerable to piercing by sharp instruments. Also, if moisture does pass through these elastomeric barriers during the autoclave operation, the moisture does not have a rapid means for escaping the handpiece following completion of the autoclave operation. The presence of moisture in an inner cavity of the handpiece, where the electronic components are stored, can cause damage and/or malfunction of the handpiece or lead to premature wear.

When the switch member is in the form of an elastomeric switch member, an integral flexible membrane may be provided around the periphery thereof. This flexible membrane is often referred to as a "web" or skirt which permits the switch member body to be readily depressed when pressed upon and return to its original position when released. There are at least two associated disadvantages of using a thin elastomeric web as part of the rocker switch member body. First, the puncture/tear resistance of the web area is limited because the web area has a relatively thin cross section and has limited durability to resist puncture from sharp instruments contacting the flexing portion (the web). Second, the thinness of the web membrane does not provide a very robust seal since air and humidity can pass through. In other words, the web membrane has a sufficiently high permeability that permits air and humidity to pass through.

One example of the difficulty that is encountered with a switch member having a high permeability occurs when the switch member is subjected to an autoclaving process. When the rocker switch member is used to seal off an inner cavity of the handpiece, an autoclave vacuum can cause the air pressure inside the inner cavity to be higher than outside of the inner cavity. The switch member has limited travel in an outward direction and thus can not accommodate the higher pressure. Consequently, the pressurized air escapes through the web membrane due to its relatively poor permeability. It is also possibly that the pressurized air can escape through other portions of the switch member body. However, during autoclave repressurization to normal atmosphere, the reduced pressure inside the inner cavity causes the switch member to deflect downward. This results in the switch member being pulled downward, similar to someone pressing on the switch member. Thus, the switch member equalizes the pressure and there is inadequate pressure differential to draw air back through the web membrane. This results in the switch member being held down without user intervention. This is not desirable because it leads to unwanted activation of the switch mechanism due to the switch member being in a depressed position.

While existing membranes have been suitable for some applications, there is a need for providing improved membranes which are good barriers to moisture ingress along with providing a good barrier to gas vapor and other gas (air) transmission along with improved resistance to puncture.

SUMMARY OF THE INVENTION

The present application is directed toward methods and switch members which control fluid flow (e.g., flow of water vapor and gases, such as air) through the switch members which are used to seal an interior cavity of a surgical handpiece and each provides a depressable member for actuating the handpiece. The switch members provide improved sealing properties which prevent transmission of fluids across the entire switch member or at least a treated portion thereof (e.g., a skirt) and into and out of the sealed internal switch chamber. The switch members are also resistant to puncture due to striking by tools or cleaning instruments, and the like.

The switch members find particularly utility in handpieces which are autoclavable. Autoclave pressures and vacuums can induce gas flow and water vapor flow across the membranes of conventional switch members and particularly, across the thin skirt portion thereof. The present application discloses various methods of controlling the gas and water vapor flow across the depressable switch member (particularly the skirt portion) such that the handpiece may be used in an autoclave environment and other adverse settings without experiencing the disadvantages associated with conventional members.

Other features and advantages will be apparent from the following detailed description when read in conjunction with the accompanying drawings.

BRIEF DESCRIPTION OF THE DRAWINGS

The foregoing and other features will be more readily apparent from the following detailed description and drawings of illustrative embodiments in which:

FIG. 9A is a bottom perspective view of a switch member according to another exemplary embodiment;

FIG. 9B is a fragmentary cross-sectional view taken along the line B—B of FIG. 9A;

FIG. 10 is a partially fragmented cross-sectional view of a switch end cap having a vent formed therein;

DESCRIPTION OF ILLUSTRATIVE EXEMPLARY EMBODIMENTS

Figure 1:
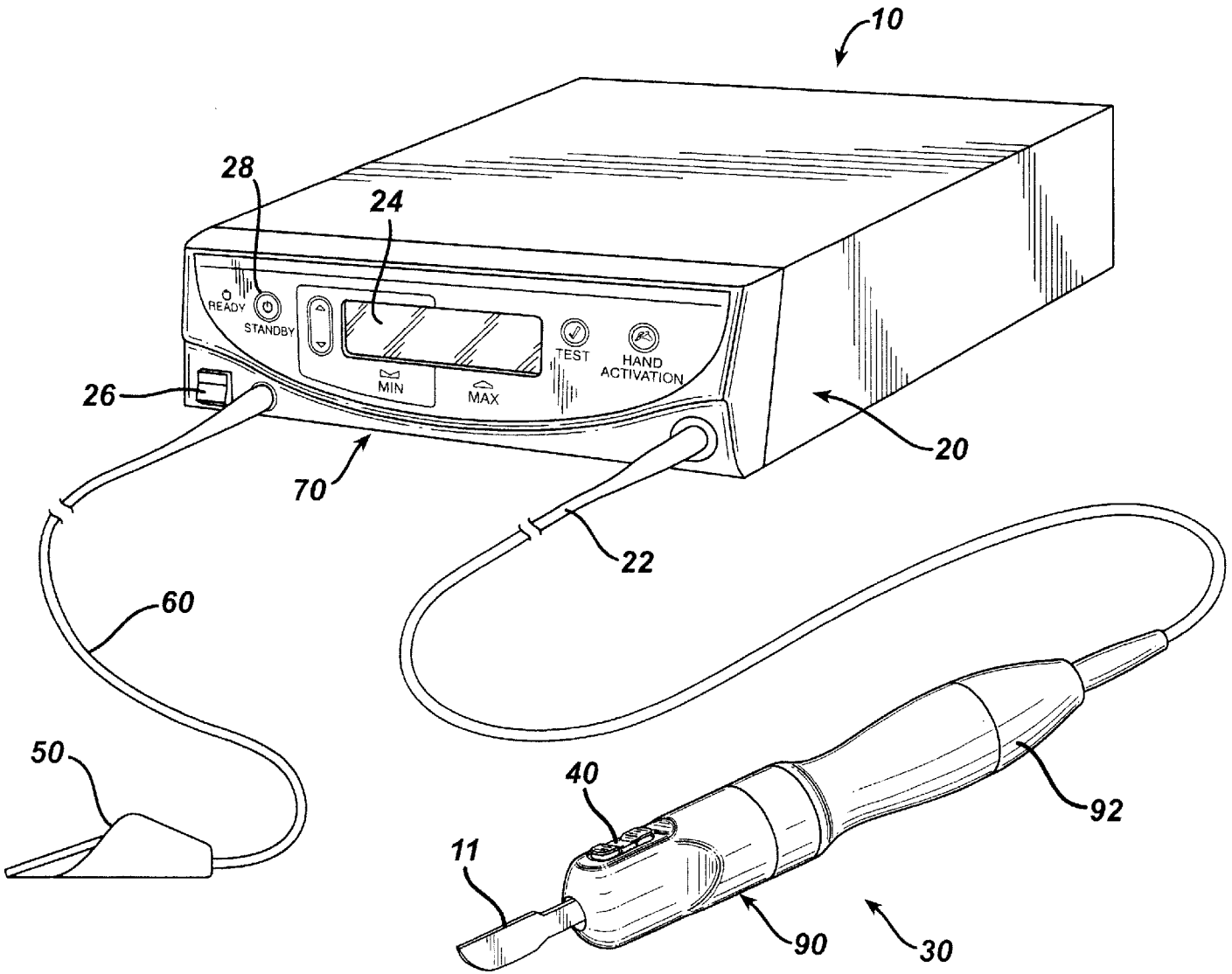
FIG. 1 is an illustration of a console for an ultrasonic surgical cutting and hemostatis system, as well as a handpiece and foot switch in accordance with an exemplary embodiment.

Referring first to FIG. 1 in which one exemplary surgical cutting and hemostatis system according to one embodiment is illustrated and generally indicated at 10. In the exemplary embodiment, the system 10 is an ultrasonic surgical system. The system 10 includes a console or housing 20 for containing an ultrasonic generator (not shown) and a control system located within the console 20 which forms a part of the system 10. A first cable 22 connects the console 20 to a handpiece 30 and serves to provide an electrical connection therebetween. The first cable 22 includes a first set of wires (not shown) which permit electrical energy, i.e., drive current, to be sent from the console 20 to the handpiece 30 where it imparts ultrasonic longitudinal movement to a surgical instrument 11. The surgical instrument 11 is preferably a scalpel blade or shear. This instrument 11 can be used for simultaneous dissection and cauterization of tissue.

The supply of ultrasonic current to the handpiece 30 is controlled by a switch mechanism 40 disposed within the handpiece 30. As will be described in greater detail hereinafter, the switch mechanism 40 is electrically connected to the console 20, more specifically the generator thereof, by one or more wires (not shown) of the first cable 22. The generator may also be optionally and further controlled by a foot switch 50 which is connected to the console 20 by a second cable 60. Thus, in use, a surgeon may apply an ultrasonic electrical signal to the handpiece 30, causing the instrument 11 to vibrate longitudinally at an ultrasonic frequency, by operating the switch mechanism 40 on the handpiece 30 or the foot switch 50. The switch mechanism 40 is activated by the hand of the surgeon and the foot switch 50 is activated by the surgeon's foot.

The console 20 also includes a liquid crystal display device 24, which can be used for indicating the selected cutting power level in various means, such as percentage of maximum cutting power or numerical power levels associated with the cutting power. The liquid crystal display device 24 can also be utilized to display other parameters of the system. A power switch 26 and power "on" indicator 28 are also provided on the console 20 to permit the user to further control the operation of system 10. Additional buttons and control switches, generally indicated at 70, control various other functions of the system 10 and may be located on the front panel of the console 20. When the power is applied to the ultrasonic handpiece 30 by operation of either switch mechanism 40 or switch 50, the surgical scalpel or instrument 11 is caused to vibrate with the amount of longitudinal movement varying proportionately with the amount of driving power (current) applied, as adjustably selected by the user.

Figure 2:
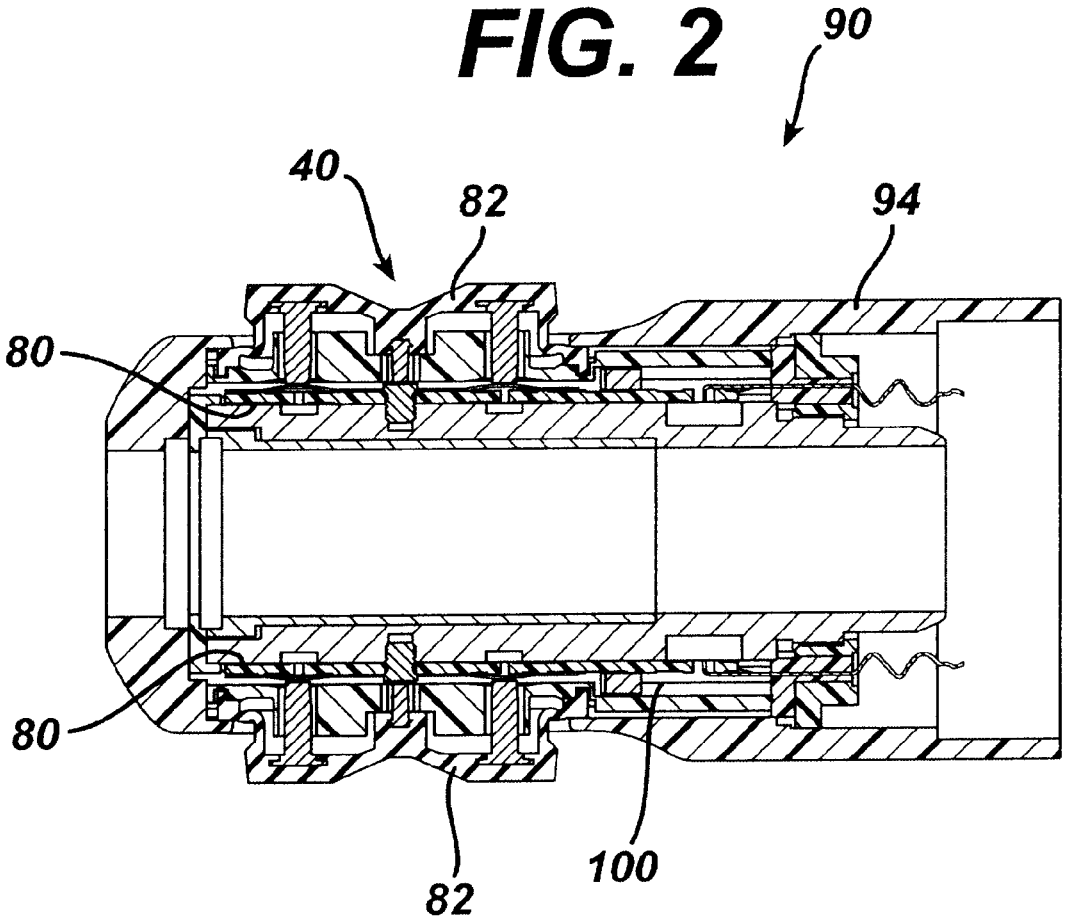
FIG. 2 is a cross-sectional view showing one exemplary switch end cap.
Figure 3:
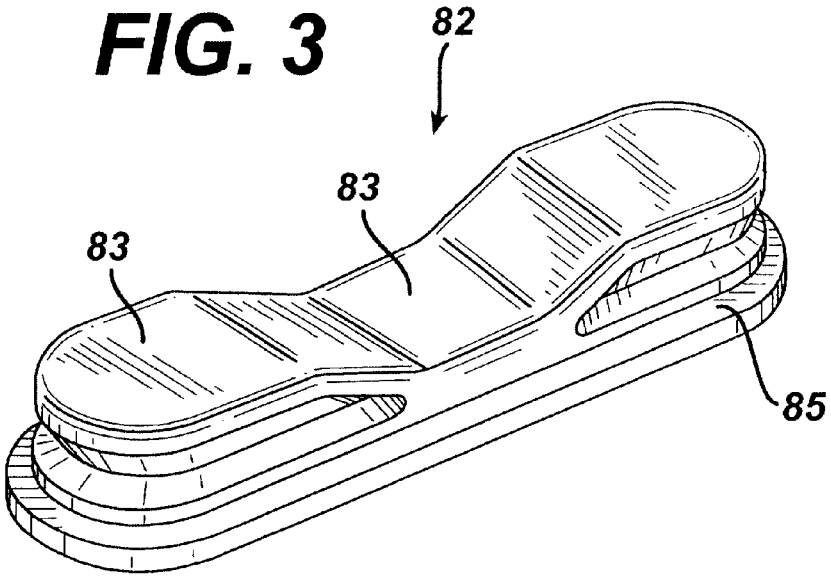
FIG. 3 is a top perspective view of one exemplary switch member for use in the switch end cap of FIG. 2.
Figure 4:
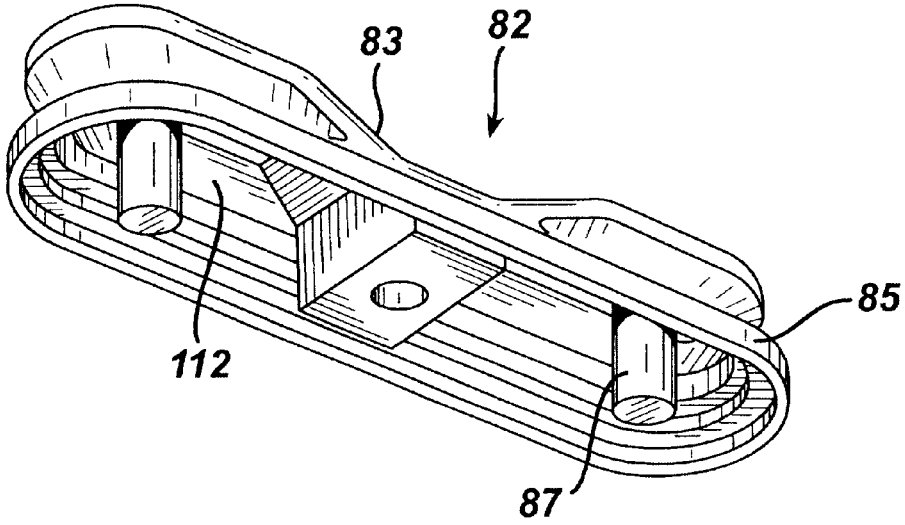
FIG. 4 is a bottom perspective view of the switch member of FIG. 3.

Now referring to FIGS. 1 through 4, one exemplary switch mechanism 40 is shown in greater detail in FIG. 2. The handpiece 10 is formed of a switch end cap 90 which is attached to a handpiece body 92. The switch mechanism 40 includes multiple electrical components, e.g., one or more circuit boards 80, and also includes one or more depressable switch members 82, which are manipulated by the user for activation or deactivation of the switch mechanism 40. For purpose of illustration only, each switch member 82 is shown in the form of a rocker type switch; however, it will be understood that the switch member 82 may comprise any number of types of depressable switch members 82 and is not limited to a rocker-type switch. The exemplary switch member 82 includes a body 83 (in this case a rocker type body) and a skirt 85 which peripherally extends around the body 83. The switch member 81 serves to seal an interior of the handpiece 10 and therefore acts as a water vapor and gas barrier (i.e., a permeability barrier to liquids and gases). Preferably, both the body 83 and the skirt 85 act as permeability barriers. The switch member 82 also includes a pair of spaced posts 87 extending outwardly from the body 83 for engaging a contact (not shown) to cause activation of the switch mechanism 40 (FIG. 1). The posts 87, in a non-compressed state, preferably do not extend below a plane containing the lower surface of the skirt 85. Because the posts 87 are preferably formed of an elastomeric material, as is the body 83 and skirt 85, a force exerted on the upper surface of the body 83 above the posts 87 causes the respective post 87 to be driven downward so that it extends beyond the plane containing the lower surface of the skirt 85. This is the compressed position of the switch member 82.

In the illustrated embodiment, the switch end cap 90 includes two opposing switch members 82 which are coupled to the switch end cap 90. The switch end cap 90 has an outer shell 94 which houses electrical switch components, such as the circuit boards 80. Because each switch member 82 is in communication with the switch mechanism 40, openings are formed in the outer shell 94 to permit the switch member 82 to engage the switch mechanism so that signals are generated by the switch mechanism 40 and delivered to the console 20 to permit operation of the handpiece 10.

The handpiece 10 is preferably intended for use in a surgical system, such as that disclosed in commonly assigned U.S. patent application Ser. No. 09/693,621, entitled "Ultrasonic Surgical System", filed Oct. 20, 2000 and the handpiece 10 is described in greater detail in U.S. patent application Ser. No. 09/693,549, entitled "Conductive Finger Adapter Retention to reduce number of Conductors", filed Oct. 20, 2000, both of which are incorporated herein by reference in their entirety.

In one aspect, an improved switch member 82, in the form of an elastomeric rocker type switch button, is disclosed. It will be understood that while the term "elastomeric" is used herein, the switch member 82 may be formed of other suitable plastics, e.g., a thermoplastic, or other materials, such as a metal with a compressible structure so that the switch member deforms under application of a force. In addition, while the discussion will focus on switch members used in switch mechanisms, one will appreciate that other types of plastic components, such as seals, walls, or other components may be substituted for the switch membranes. Furthermore, while exemplary switch members are discussed herein as being of a rocker type, it is understood that the scope of the present application covers other types of switch members. Accordingly, the description and illustration of rocker type switch members is merely exemplary and not limiting.

Figure 5A:
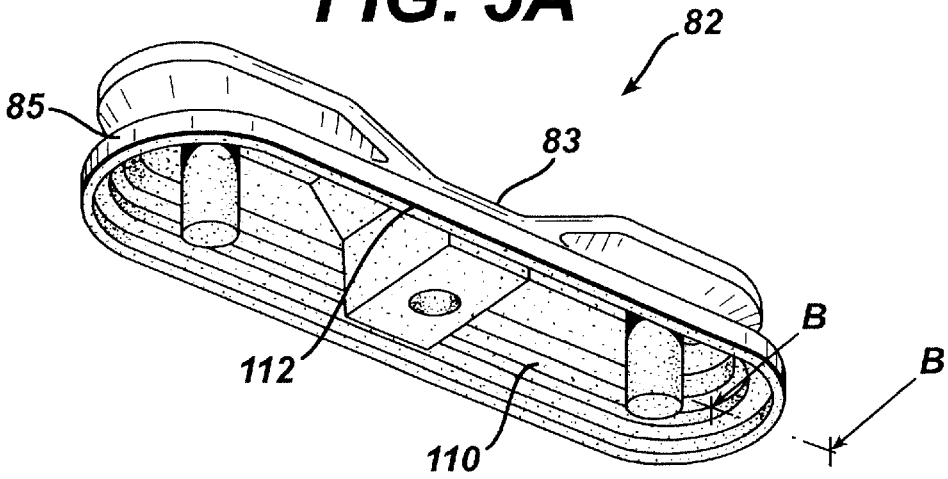
FIG. 5A is a bottom perspective view of a switch member according to one exemplary embodiment.
Figure 5B:
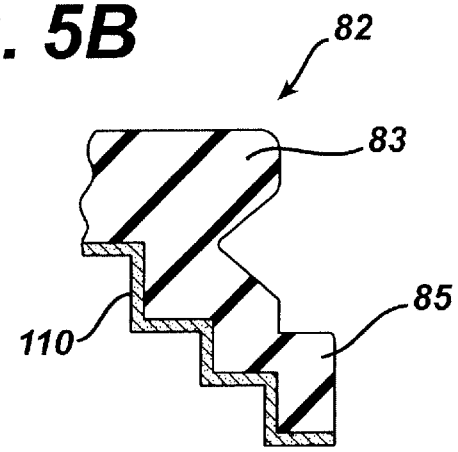
FIG. 5B is a fragmentary cross-sectional view taken along the line B—B of FIG. 5A.

Referring to FIGS. 3–5B, in one exemplary embodiment, a metallic layer 110 is applied to the elastomeric rocker type switch member 82, as shown in FIG. 5A. Preferably, the skirt 85 is integrally formed with the body 83. More specifically, the metallic layer 110 is applied to an underside 112 of the elastomeric rocker switch member 82. The layer 110 may be formed from any number of suitable metal materials, e.g., aluminum, gold, titanium, platinum. The layer 110 is in the form of a thin layer of metal which is applied to predetermined sections of the underside 112 of the body 83 and the skirt 85. For example, the complete underside 112 (including the body 83 and skirt 85) may be coated with the metallic layer 110 which is a thin coating (for example, the thickness may be from about 5 $\mu$inch to about 0.0005 inch. Alternatively, only the skirt 85 of the switch member 82 has the metallic layer 110 disposed thereon. The metallic layer 110 dramatically reduces the water vapor and gas transmission rates of the treated part, e.g., the underside 112. Since the layer 110 is very thin, the layer 110 is flexible and does not hinder the flexibility of the elastomeric part (the switch member 82). The presence of the metallic layer 110 thus improves the seal properties of the switch member 82. The metallic layer 110 is not limited to being applied to only the underside 112 but rather the metallic layer 110 may be formed in an intermediate layer of the switch member 82 between the upper surface and the underside 112. The metallic layer 110 may be formed only in an intermediate layer of the skirt 85. The metallic layer 110 may also be applied to the upper surface of the member 82 by itself or in combination with being disposed on the underside 112 or at an intermediate layer. The metallic layer 110 can be applied using conventional techniques, including using a spray apparatus or other type of equipment that serves to apply a thin metallic layer, preferably of uniform thickness, to a body. Other techniques that may be used to apply the metallic layer 110 include but are not limited to ion beam deposition, metal vapor deposition, and chemical vapor deposition.

Figure 6:
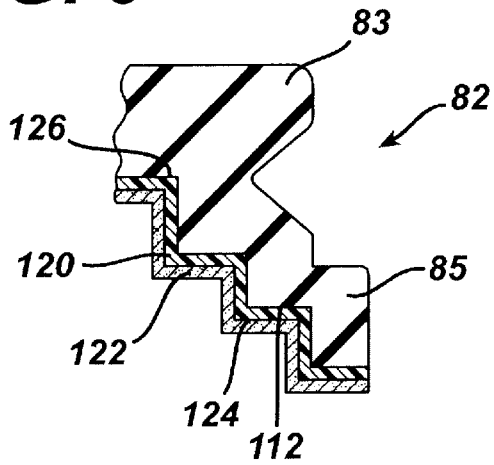
FIG. 6 is a fragmentary cross-sectional view of a switch member according to another exemplary embodiment where a substrate is provided between the switch member and a permeability barrier.

In another embodiment, shown in FIG. 6, a thin flexible substrate 120 is provided and is coated with a metallic layer 122. The substrate 120 is preferably formed of a flexible material, such as polyurethane, vinyl, silicone, a thermoplastic elastomer, polyvinylidenefluoride, polyparaphenylene terephthalamide, polyimide, and a combination of any of the foregoing. For example, a polyimide film may be coated with an FEP fluoropolymer resin to provide a moisture barrier and a slippery surface that reduces the tendency for a tool to puncture the member. In one exemplary embodiment, the substrate 120 has a thickness from about 0.0005 inch to about 0.003 inch. The metallic layer 122 may be formed of any number of suitable metals, including but not limited to aluminum, gold, titanium, and platinum. Preferably, the metallic layer 122 is formed of a metal which permits the metallic layer 122 to be thin, while at the same time, the metallic layer 122 has low water vapor and gas transmission rates. The thickness of the metallic layer 122, in one embodiment, is between about 5 $\mu$ inch and about 0.0005 inch. The metallic layer 122 is formed on a first surface 124 of the thin flexible film substrate 120. An opposing second surface 126 of the thin flexible film substrate 120 is attached to or faces the underside 112 of the elastomeric rocker switch member 82 when the handpiece 30 is assembled. In one embodiment, the substrate 120 is adhered to the underside 112 of the switch member 82 using an adhesive. The thin flexible film substrate 120 may be placed on or just underneath the underside 112. For example, the thin flexible film substrate 120 may be in laminated contact with the elastomeric rocker switch member 82 such that the metallic layer 122 faces away from the elastomeric rocker switch member 82 as shown in FIG. 6. The thin flexible film substrate 120 may also be positioned in close proximity yet separated from the elastomeric rocker switch member 82. It will be understood that the substrate 120 may be applied to select portions of the underside 112. For example, the substrate 120 may be applied only to the underside of skirt 85 or may be applied to the complete underside 112.

Referring to FIGS. 1–4, in another embodiment, the water vapor and gas transmission rates are reduced by structurally altering a surface, e.g., underside 112, of the elastomeric switch member 82 via an ion implantation process. In an ion implantation process, the surface properties of the switch member 82 are modified while leaving the bulk properties intact. Treatment can be to the underside 112 and/or an upper surface of the member 82 or a laminate affixed to the member 82 resulting in cross-linking of the polymer chains in three dimensions. Once again, the surface treatment may be to an entire surface or it may only be to selected surfaces, such as the underside of the skirt 85. By using a suitable ion implantation process, the pore size/porosity of the member 82 is reduced resulting in the water vapor and gas transmission rates being likewise reduced because the water vapor and gas are unable to be transmitted through the elastomeric switch member 82 due to this permeability barrier being formed. Another benefit of ion implantation is the improved strength and surface hardness which improves the switch member's puncture resistance, thereby reducing the likelihood that a puncture may occur. For example, during a normal sterilization cleaning process (e.g., an autoclave operation), instruments, such as wire brushes, are used that may puncture weak conventional switch membranes.

Another method of altering a surface of the member 82, such as the underside 112, is to shallow melt or heat fuse the surface to more tightly bond the surface molecules together. One such process for accomplishing this is a laser sintering process which modifies the underside surface 112 and/or top surface so that the molecules thereat are more tightly bonded. This makes it more difficult for the water vapor and gas (e.g., air) to be transmitted through the underside 112 and thus a reduction in the water vapor and gas transmission rates is realized. Ion beam assisted deposition or low temperature arc vapor deposition can be used to deposit materials with low gas permeability on the underside 112, such as ceramics, metals and polymers, thereby providing a water vapor and gas diffusion barrier. Ceramics which may be used include, but are not limited to, alumina, silicon dioxide, and metals include, but are not limited to, aluminum, gold, titanium, platinum, alloys, or combinations thereof can be used in sequential layers. The entire underside 112 of the body 83 and skirt 85 may be surface treated or select portions of the underside 112 may be treated. For example, only the underside of the skirt 85 may be surface treated.

Any pressure differential problems experienced across the member 82 (such as during an autoclave cleaning process) can be reduced to insignificant levels by reducing the volume of air in the sealed switch chamber underneath the member 82. Filling the void area under the member 82 reduces the amount of air under the member 82 that is influenced by heat and pressure, thereby reducing the differential pressure across the member 82 and subsequently reducing the adverse effects to the switch member 82. This is especially noticed in applications, e.g., autoclave process, where a force acts on the member 82. It will be appreciated that a small area under the member 82 is needed so as to allow the posts 87 or the like to move as the member 82 is depressed or when it returns to a non-compressed position.

Figure 7:
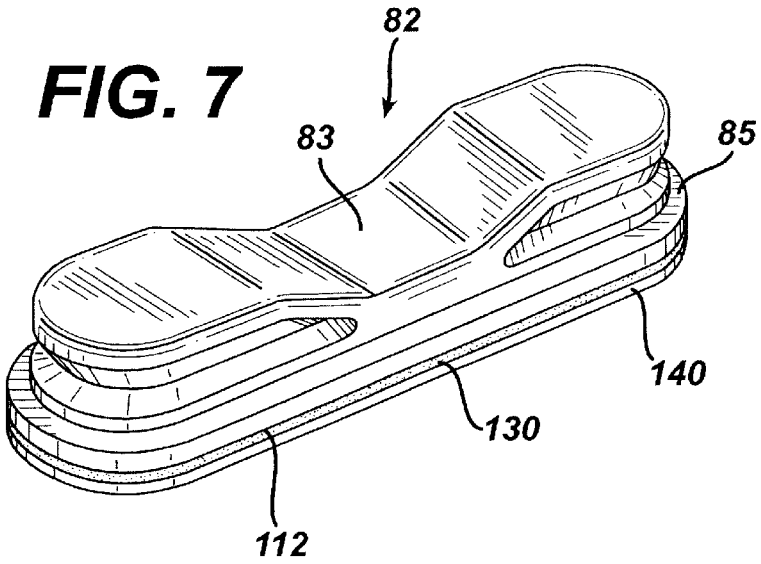
FIG. 7 is a top perspective view of a switch member according to another exemplary embodiment.

Yet another method for reducing the water vapor and gas transmission rates is to apply a petroleum product, e.g., an oil or grease film 130, to the elastomeric switch member 82, particularly to the underside 112 where it will not be disturbed from user handling, as shown in FIG. 7. For example, a petroleum jelly 130 may be applied to the entire underside 112 or select portions thereof. This oil or grease film 130 could be further prevented from migration by placing a laminate 140 over the oil or grease film 130. The laminate 140 acts as a cover to retain and contain the oil or grease film 130. A similar method is to mix silicone oil or another type of compatible oil or grease into the elastomeric rocker switch member 82. This reduces the water vapor transmission rate. Once again, a barrier film, such as the laminate 140, could be used to prohibit migration of residual oils to parts that do not tolerate the oils.

The water vapor and gas transmission rates of the elastomeric switch member 82 may also be reduced by subjecting the elastomeric switch member 82 to a cryogenic temperature environment to reorganize and/or more tightly organize and/or refine the molecular microcrystallinic structure of the elastomeric switch member 82. This results in a decrease in the porosity, water vapor and gas transmission rates, and improves gas sealing capability of the elastomeric switch member 82. One suitable technique is to introduce the elastomeric switch member 82 into a progressive thermally controlled liquid nitrogen treatment. Another benefit of this treatment is improved strength (ruggedness) and resistance to puncture of the elastomeric switch member 82. This is particularly beneficial for durability of thin members being heavily flexed or challenged by pointed instruments.

One of skill in the art will further understand that combinations of the above method may be used according to the present invention. For example, a relatively thick elastomeric switch member 82 may be used with a grease coating being applied in the area of the thin flexible joint area. Another example would be a switch button that has a thin flexible perimeter with a solid low-porosity, non-elastomer switch button being fused to a relatively porous flexible member, resulting in a narrow flexible skirt around the body. The resulting assembly has only a small surface area with relatively higher vapor transmission rate, thus the amount of vapor passing into the handpiece 10 is negligible.

Figure 8A:
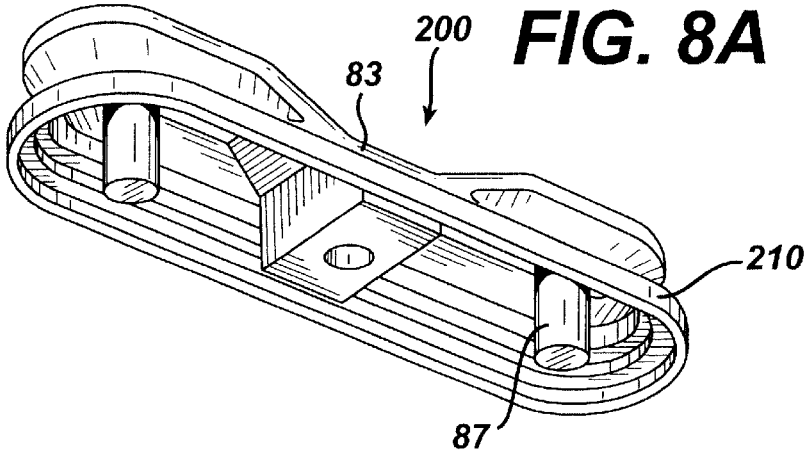
FIG. 8A is a bottom perspective view of a switch member according to to another exemplary embodiment.

Referring to FIG. 8 and accordance with the present invention, a web membrane area (e.g., the skirt surrounding the rocker body) of a rocker switch member 200 is replaced with a puncture resistant flexible material 210 made from materials, such as polyimide, a polyester, polyparaphenylene terephthalamide, and thermoplastic elastomers (referred to hereinafter as a "puncture resistant skirt"). In an exemplary embodiment, the puncture resistant skirt 210 has a thickness between about 0.0005 inch and about 0.003 inch. One method of creating such device 200 is to attach (e.g., adhere) a rocker shaped element 83 on top of the puncture resistant skirt 210, thereby providing a profile of a rocker with the benefits of a flexible web zone with puncture/slit resistance that is superior to thin wall elastomers. Another method is to insert mold the puncture resistant skirt 210 into the rocker body, creating an integral two-material item that combines the benefits of a profiled rocker and a durable web (skirt). The puncture resistant skirt 210 acts as the skirt 85 of FIG. 3.

Figure 8B:
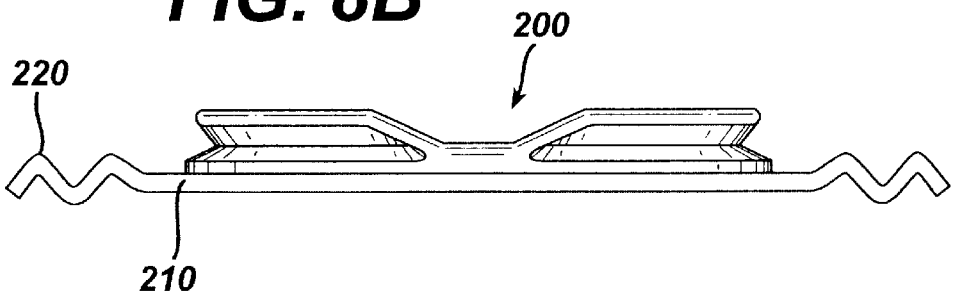
FIG. 8B is a side view of a switch member according to another embodiment.

The flexibility and displacement ability can be further enhanced by fabricating folds or rolls 220 into the puncture resistant skirt 210 as shown in FIG. 8B. Due to the superior puncture resistance of the puncture resistant skirt 210, the flex area is substantially more resistant to puncture than an elastomeric web (skirt). These folds/rolls 220 provide a spring-like return action that returns the rocker 200 to its upward position when the rocker 200 is no longer depressed. These folds/rolls 220 may also provide detent snap action behavior that provides tactile feedback to the user. Springs or domes (not shown) may be used under the rocker 200 if needed to supplement or completely provide the means for rocker return upward when the rocker 200 is released. Plastic springs/domes may be especially useful due to their non-corrosive nature in the presence of steam and heat. Also, the puncture resistant skirt 210 has improved resistance to air flow through it, thus reducing the permeability of the rocker 200. This reduced permeability facilitates proper behavior of the rocker during and after autoclaving.

Furthermore, selection of the film to form the puncture resistant skirt 210 or a supplemental coating that has a relatively low friction slick surface (compared to an elastomer which has a higher friction) discourages puncture/slitting during cleaning/handling. Suitable low friction materials include but are not limited to polyimides, polyseters, polytetrafluoroethylene materials, and titanium nitride. For example, instruments, such as brushes, striking a slippery member are more apt to slide across the member than pierce it, as compared to a normal elastomeric member. Thus, forming the puncture resistant skirt 210 so that at least a surface thereof has a low friction surface enhances the puncture resistance of the puncture resistant skirt 210. A supplemental surface treatment, such as ion-implantation, may also be used.

Another method of improving the switch member 200 for better durability and improved resistance to passage of air/humidity is to keep the web membrane intact but surface treat predetermined surfaces of the switch member 200 using a suitable surface treatment process. More specifically, at least the web membrane area (skirt) is surface treated and preferably, the surface treatment is done to the interior (underside) and/or exterior of the rocker switch member 200. For example, the entire underside may be surface treated. Surface treatments that can be used include, but are not limited to, applying parylene, ceramics (such as silicone dioxide, titanium nitride, etc.), metal coatings (such as aluminum, gold, titanium, platinum, etc.) or other suitable coating materials having the desired properties.

As shown in FIGS. 9A and 9B, another method of improving an elastomer switch member 300 for better durability and improved resistance is to impregnate the elastomeric resin that is used to make the elastomeric switch member 300 with microspheres 310. The microspheres 310 may be formed of any number of materials and in an exemplary embodiment, the microspheres 310 are made of glass, carbon, silicon, aluminumoxide, alumina etc. The microspheres 310 may be solid or hollow. These microspheres 310 provide a pierce-resistant substrate and reduce the permeability of a skirt 312 and/or a body portion 314 of the member 300 since they impede gas flow. Because the microspheres 310 have a very small diameter, e.g., from about 15 microns to about 100 microns, and have a generally annular shape, the microspheres 310 do not significantly interfere with web flexibility. However, the microspheres 310 may have any number of other shapes. Alternatively, the elastomer may be impregnated with superfine fibers such as quartz fibers, ceramic fibers, synthetic fibers, such as polyvinylidenefluoride fibers, having an exemplary diameter from about 1 to about 15 microns. Another method of reducing the water vapor and gas transmission rates is to increase the thickness of the elastomeric switch member over most of the part, leaving the part thin only where it functionally needs to be of reduced thickness. Increased thickness of the elastomeric switch member dramatically reduces the vapor transmission rate. The microspheres 310 may be located only in the skirt 312 or may be dispersed throughout the entire switch member, including the body 314 and the skirt 312 areas.

As previously-mentioned, the thinness of the skirt (i.e., a flexible seal) may not provide a very robust seal, since air and humidity can pass through. In other words, the permeability of the skirt is high in conventional configurations. While it is desired that the skirt have a low permeability, some amount of permeability is typically present. The amount of gas/humidity passage across the skirt and other portions of the member is dependent upon on the pressure difference on each side of the member.

The switch member 82 (FIG. 3) is designed to provide substantial displacement in an outward/upward direction and an inward/downward direction. This symmetrical displacement capability reduces the differential pressure across the member, thereby reducing the gas/humidity flow across the member. By reducing the flow across the member, the rocker is able to return to it normal position after autoclaving unlike conventional rockers which tended to be held down without user intervention, as previously-described. Another benefit of reduced flow is higher reliability since humidity is not as readily traveling inside the sealed chamber to potentially influence components.

According to the present invention, the symmetrical displacement can be accomplished by several means. One example is the use of folds or rolls 220 as shown in the switch member 200 of FIG. 8B. The use of folds/rolls 220 in the skirt region 210 permits upward motion as well as downward motion. Another method is to provide adequate slack in the member which permits member expansion outward as well as inward. Furthermore, an elastic material, e.g., polyurethane, that readily elongates may be used to form the rocker, thereby permitting the rocker to expand outward. In all of these embodiments, the differential pressure across the member is controlled through adequate rocker motion in both directions.

Referring now to FIG. 10 in which another embodiment to avoid the difficulties associated with differential pressure across the member is to use a vent that does not allow fluid into the sealed interior cavity 100 but allows for pressure equalization. The main purpose for sealing the interior cavity 100 is to prevent fluids (e.g., water, saline, cleaners, blood, etc.) from entering the sealed interior cavity 100 which houses the switch mechanism 40 (FIG. 2). Ingress of such materials could corrode or otherwise jeopardize the functionality of the switch mechanism 40 and could provide debris to the interior cavity 100 that would be unacceptable from a sterility standpoint, especially if it were to leak out subsequently. The vent according to the present invention does not permit fluid to enter the interior cavity 100 and if for some reason, fluid did enter the interior cavity 100, the vent would resist fluid flow outward toward the patient.

Referring still to FIG. 10 in which one exemplary method of venting gas yet blocking fluids from entering the interior cavity 100 is shown. In situations where it is difficult to seal off the handpiece interior cavity 100 due to material porosity, the water vapor may aggressively enter the interior cavity 100 (due to autoclave pressures) but only slowly exit back through the elastomeric rocker switch member 82 since the pressure and heat are not advantageous following autoclave. A vent 150 is formed in the outer shell 91 of the switch end cap 90 and is covered with a microporous hydrophobic membrane 160. The microporous hydrophobic membrane 160 is formed from any number of suitable hydrophobic materials, including but not limited to polytetrafluoroethylene (PTFE) and polypropylene. The hydrophobic membrane 160 permits air to freely enter and exit the handpiece 30 but blocks the entrance of liquids. Thus, while air can rapidly enter the interior cavity 100 of the handpiece 30, it will also exit the handpiece 30 in a reasonably short period of time. The hydrophobic membrane 160 permits air pressure equalization between the interior cavity 100 and the exterior of the handpiece 30 (FIG. 1) while at the same time, liquids are blocked. The microporous hydrophobic membrane barrier 160 also acts as a viral and bacterial barrier that filters the air entering and leaving through it.

In another embodiment, one or more vent holes are formed in the switch end cap 90 and are of a size which permits gasses to travel therethrough; however, liquids, such as water, are not inclined to traveling through the vent 150 due to the small size of the vent 150. In other words, because of the surface tension, liquids do not readily pass through the one or more vent openings. The resistance to liquid passage of the one or more vent holes may be enhanced by disposing a hydrophobic material within the hole wall or by using a hydrophobic mesh (i.e. hydrophobic membrane 160 of FIG. 10) across the hole opening. Another method involves providing torturous path vent holes. By using a relatively long passage way vent hole (e.g., about 0.1 to about 1.0 inch long with a diameter of about 0.01 inches according to one embodiment), liquid ingress into the sealed interior cavity 100 is further discouraged. The use of a single vent hole can discourage liquid flow since the single torturous path passage into the sealed interior cavity 100 does not really allow simultaneous passage of liquid in one direction into the interior cavity 100 and displacement of gas, e.g., air, in the other direction.

Alternatively, vent 150 may be located such that when the switch end cap 90 is fully assembled, the vent 150 is not fully accessible. Thereby, any remote chance of residual fluid flow out the vent 150 will not present itself to the user/patient. Instead, it is harmlessly emitted into another fairly contained space within the assembled handpiece.

Figure 11:
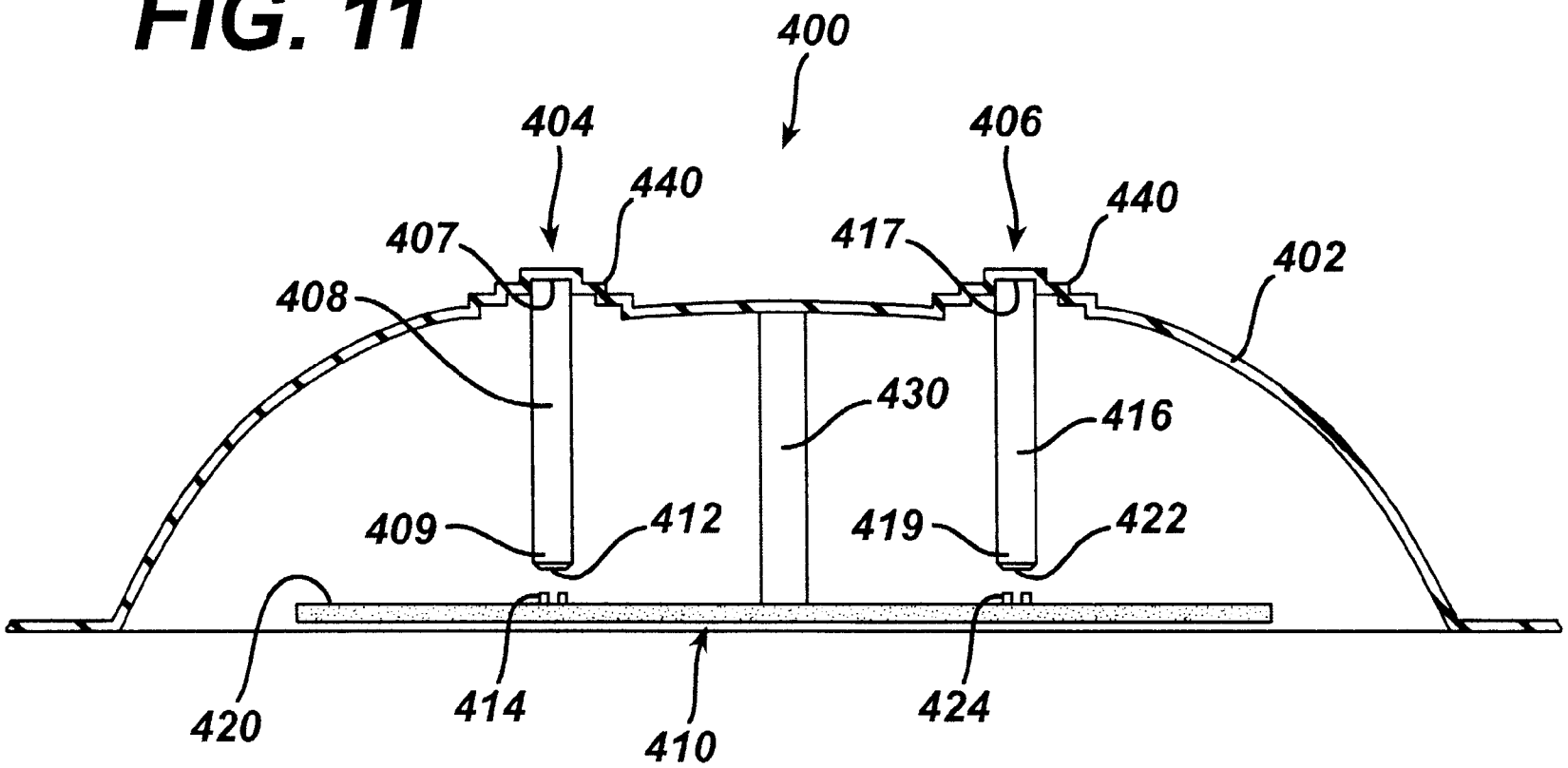
FIG. 11 is a cross-sectional view of a durable switch assembly according to another embodiment.

Referring now to FIG. 11 in which a durable switch assembly is shown and generally indicated at 400. The switch assembly 400 is easily depressed with light pressure yet has a relatively thick outer shell 402 that is resistant to piercing damage and gas flow. For example and according to one exemplary embodiment, the thickness of the outer shell 402 is from about 0.04 inches to about 0.06 inches. Outer shell 402 is in the form of a bubble dome shaped finger depressing shell and may be formed of various materials, including but not limited to, polyimides, polyesters, and other suitable materials. The outer shell 402 has two active regions, namely a first region 404 and a second region 406. Due to the dome shape, the outer shell 402 is readily deformable by finger pressure to cause activation of the switch mechanism 410. The first region 404 has a first post 408 extending from the outer shell 402 towards the switch mechanism 410. One end 407 of the first post 408 is connected, preferably integrally, to the outer shell 402 and an opposite end 409 is disposed proximate to but not in contact with the switch mechanism 410 in the rest position shown in FIG. 11. The second end 409 has a first contact pad 412 which engages a first switch pad 414 formed on a PCB 420, which forms a part of the switch mechanism 410. The first switch pad 414 is preferably axially aligned with the first contact pad 412 so that depressing the first region 404 causes the first contact pad 412 to contact the first switch pad 414 resulting in activation of the switch mechanism 410.

Similarly, the second region 406 has a second post 416 extending from the outer shell 402 towards the switch mechanism 410. One end 417 of the second post 416 is connected, preferably integrally, to the outer shell 402 and an opposite end 419 is disposed proximate to but not in contact with the switch mechanism 410 in the rest position shown in FIG. 9. The second end 419 has a second contact pad 422 which engages a second switch pad 424 formed on the PCB 420, which forms a part of the switch mechanism 410. The second switch pad 414 is preferably axially aligned with the second contact pad 422 so that depressing the second region 406 causes the second contact pad 422 to contact the second switch pad 424 resulting in activation of the switch mechanism 410.

Optionally, a center support post 430 may be provided to reduce inadvertent activation when holding or pressing the center of the outer shell 402. The center support post 430 extends from the outer shell 402 to the switch mechanism 410. In the rest position of FIG. 11, the center support post 430 rests against or is in close proximity to an inactive portion of the switch mechanism 410. Furthermore, each of the first and second regions 404, 406 may have its own flexible membrane (not shown) to further reduce depression activation pressure. The exemplary outer shell 402 illustrates a stepped zone 440 provided at each of the first and second regions 404, 406. The stepped zones 440 provide a finger contact point for the user to depress so that the respective first and second posts 408, 416 is directed downward toward the switch mechanism 410. Preferably, the centermost portion of the zone 440 is positioned directly above one of the first and second posts 408, 416.

Referring now to FIGS. 12–15, a second exemplary switch end cap is shown and generally indicated at 500. The switch end cap 500 is of a different configuration than the rocker type switch shown in FIG. 2. The switch end cap 500 has a pair of bellow type switch assemblies 510 which are coupled to an outer shell 520 of the switch end cap 500. The outer shell 520 houses electrical switch components 530, such as circuit boards 532, which generally act to provide switch signals when actuated by the user. Each of the circuit boards 532 has two depressable contact pads 534 which provide the signals typically as a result of a circuit being closed due to the depression of one of the contact pads 534.

Each switch assembly 510 includes a switch retainer 512, a pair of bellows 514, and an upper gasket 516. Unlike the unibody rocker type switch member 81 of FIG. 2, the switch assembly 510 utilizes two separate bellows 514 which act as depressable switch buttons for causing a signal to be generated. By physically separating the bellows 514, the risk that the user will depress both switch buttons is greatly reduced. To accommodate the switch assemblies 510, the outer shell 520 has a pair of spaced openings 522 formed therein. The openings 522 should have complimentary shapes relative to the bellows 514. In the exemplary embodiment, the bellows 514 have annular shapes and therefore, the openings 522 are generally annular in shape. The openings 522 should also be sized to receive the bellows 514 so that at least a portion of the bellows 514 extend therethrough.

Figure 12:
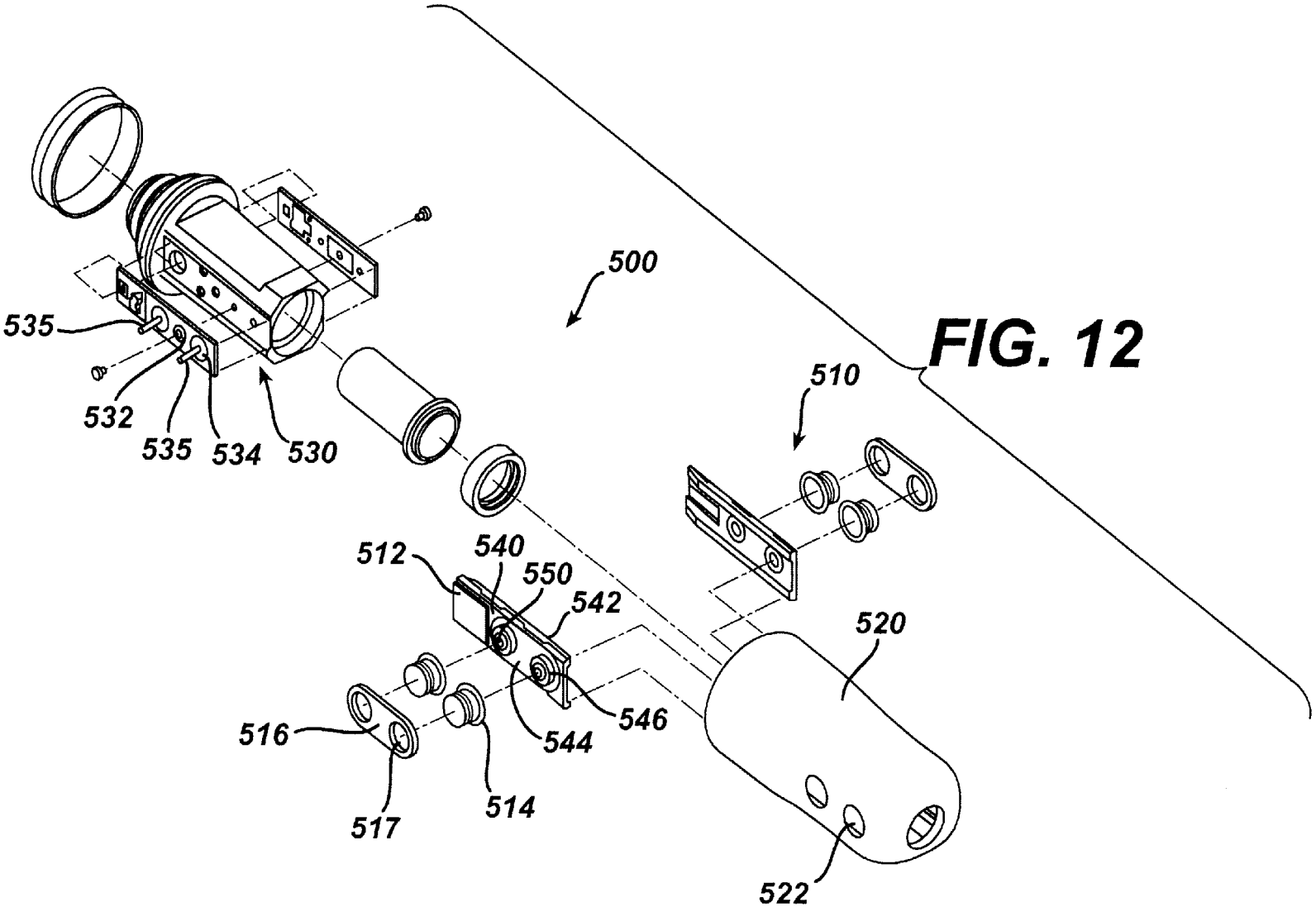
FIG. 12 is an exploded view of a switch end cap according to another exemplary embodiment.
Figure 13:
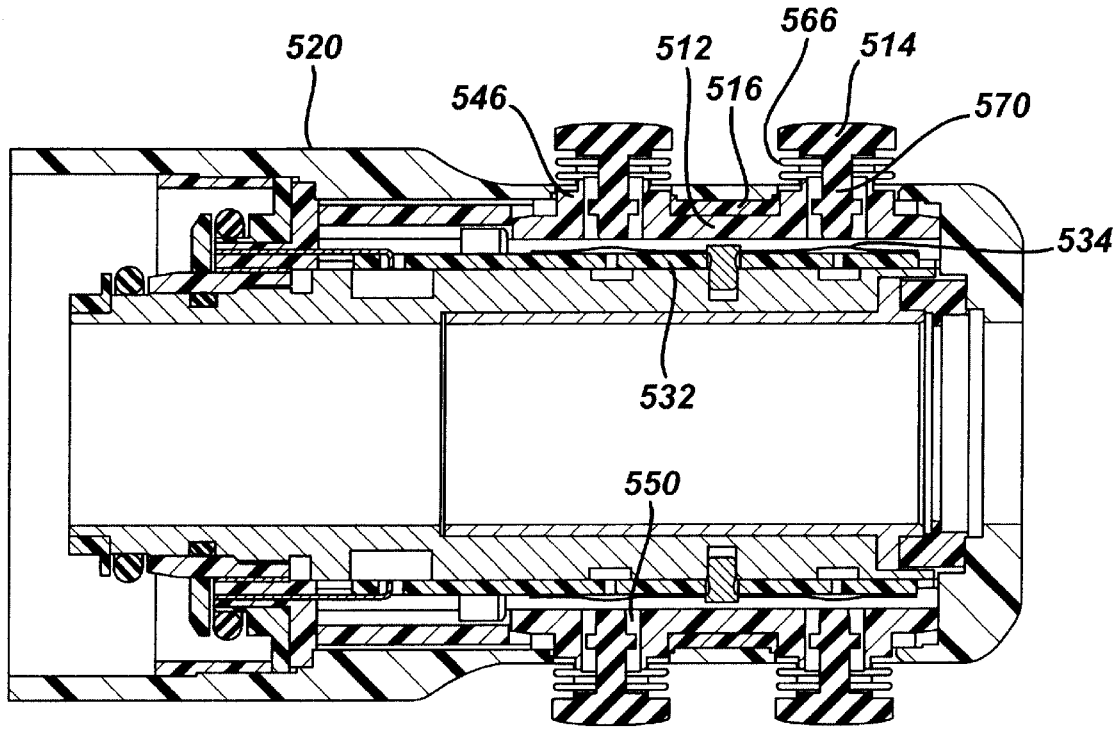
FIG. 13 is a cross-sectional view of switch end cap of FIG. 12 in an assembled state.

Each switch retainer 512 is disposed over one respective circuit board 532. Accordingly, the dimensions and shape of the switch retainer 512 are preferably complimentary to the circuit board 532. In the exemplary embodiment, each of the switch retainer 512 and the circuit board 532 has a generally rectangular shape. The switch retainer 512 has a first surface 540 and an opposing second surface 542 which faces the circuit board 532. The first surface 540 has a first platform 544 formed thereon. The first platform 544 has a planar portion and also has a pair of raised stepped sections 546 formed thereon. Each stepped section 546 is formed of a pair of stacked concentric rings of varying diameters, as best shown in FIGS. 12 and 13. The ring with the greater diameter is the lowermost ring with the other ring, having the lesser diameter, being formed on the lowermost ring so as to form a projecting structure formed on the first platform 544.

Each stepped section 546 has an opening 550 formed therethrough. The opening 550 extends completely through the switch retainer 512. The stepped sections 546 are spaced from another so that a gap is formed therebetween. The stepped sections 546 are spaced so that they are generally axially aligned and disposed over the contact pads 534 of the circuit board 532. Consequently, the openings 550 are axially aligned with the contact pads 534 when the retainer 512 is disposed over the circuit board 532 in the assembled state. As best shown in FIGS. 12 and 13, the first surface 540 of the retainer 512 seats against upper gasket 516 with the pair of stepped sections 546 being axially aligned with and disposed underneath the openings 522 formed in the outer shell 520. A portion of the outer ring of the stepped section 546 may protrude slightly from the outer shell 520.

Figure 14:
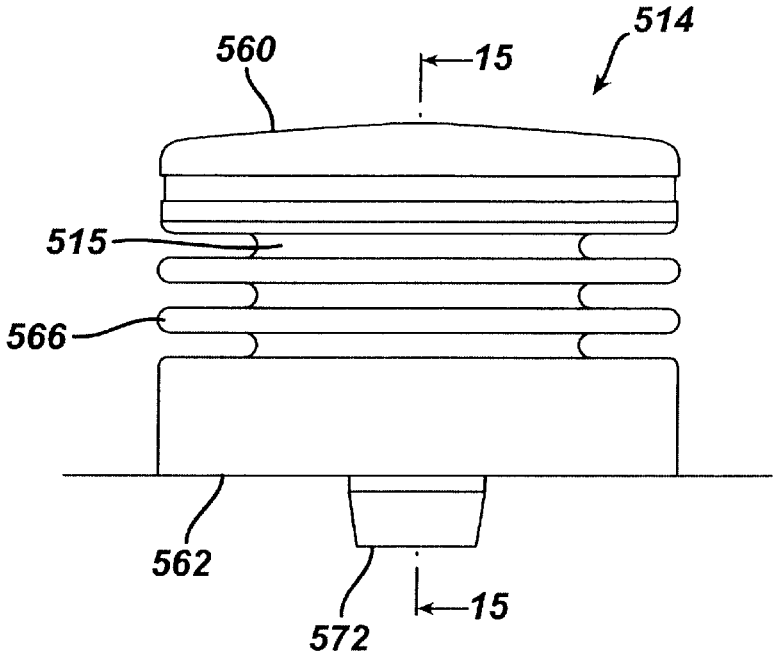
FIG. 14 is a side elevational view of a bellow switch used in the switch end cap of FIG. 12.
Figure 15:
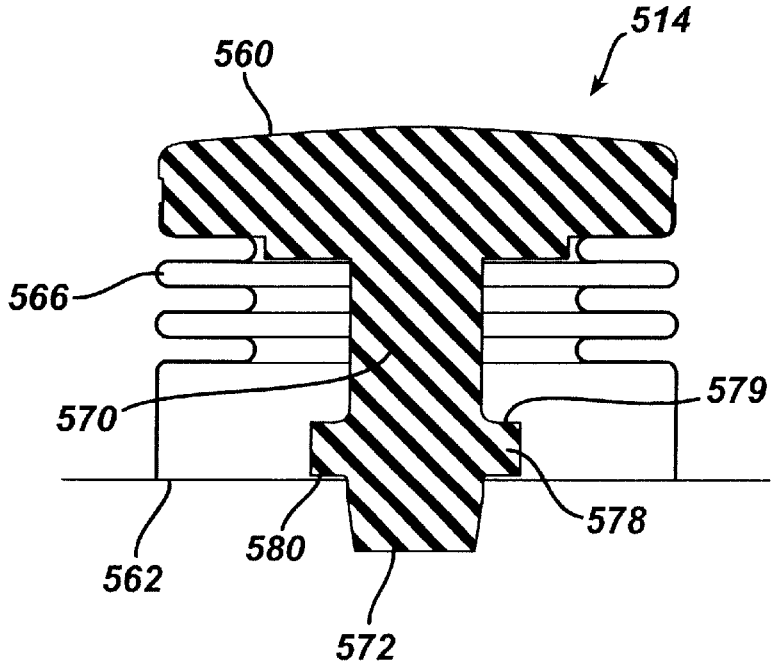
FIG. 15 is a cross-sectional view taken along the line 15—15 of FIG. 14.

FIGS. 14 and 15 best illustrate the configuration of the exemplary bellows 514. FIG. 14 is a side elevational view of the bellow 514 and FIG. 15 is a cross-sectional view of the bellow 514. The bellow 514 has a body 515 with an upper section 560 which serves as a contact surface between the user's finger or thumb and the bellow 514 as it is depressed or released. The body 515 also has a lower section 562 which seats against and mates with one respective stepped section 546. Between the upper section 560 and the lower section 562, the bellow body 515 has a number of integral folds 566. In the exemplary embodiment, the folds 566 are annular in shape and are spaced from another. The diameter of the folds 566 is preferably approximately equal to the diameter of the upper and lower sections 560, 562; however, the body 515 has a lesser diameter between the folds 566. The folds 566 thus form a generally accordion-like structure.

The folds 566 give the bellow 514 spring-like characteristics as the accordion-like structure folds when pressure is applied to the upper section 560. As soon as the pressure is removed from the upper section 560, the compressed folds 566 expand, thereby returning the bellow 514 to its original state. In one exemplary embodiment, the bellow 514 is made of a folded metal material; however, other materials may be used so long as the materials provide the bellow 514 with the above-described spring-like characteristics. For example, the bellow 514 may be formed of nickel with a gold coating or it may be formed of beryllium copper. In an exemplary embodiment, the thickness of the metal bellow 514 is from about 0.0005 inch to about 0.002 inch.

As best shown in FIG. 15, the bellow 514 has a post 570 attached to the upper section 560. Preferably, post 570 is integrally formed with the upper section 560. The body 515 of the bellow 514 has a central compartment formed therein with the folds 566 surrounding the central compartment and radially extending therefrom. The central compartment is open only at the second section 562 and is configured so that the post 570 extends through the central compartment and through the opening formed in the lower section 562. In a first non-compressed position, as shown in FIGS. 14 and 15, a lowermost tip 572 of the post 570 extends below the lower section 562. The post 570 has a generally annular cross-section of varying diameter in different sections along the length of the post 570. More specifically, the post 570 has an annular flange 578 which has a greater diameter than the surrounding sections of the post 570. The annular flange 578 thus defines a first shoulder 579 and a second shoulder 580, closer to the lowermost tip 572. The post 570 has a slight taper from the second shoulder 580 to the lowermost tip 572.

Because the post 570 is connected to the upper section 560 and is movable within the central compartment, a force applied to the upper section 560 and the resulting compression of the folds 566 causes the post 570 to be directed downward through the central compartment. This results in even a greater length of the post 570 protruding below the lower section 562 when the bellow 514 is in this compressed position. As best shown in FIGS. 13 and 15, the post 570 is received within the opening 550 formed through the switch retainer 512. The opening 550 has a diameter that is slightly larger than the diameter of the annular flange 578. In the non-compressed position and when the switch end cap 500 is assembled, the lowermost tip 572 does not extend below or only slightly extends below the second surface 542 of the retainer 512. Because the openings 550 of the switch retainer 512 are axially aligned with the contact pads 534, the posts 570 are likewise axially aligned with the contact pads 534. The contact pads 534 of the circuit boards 532 are preferably collapsible domes, whereby the circuit is completed when one of the domes is collapsed. The collapsible dome is a self-returning structure in that once a force that causes the collapsing of the dome is removed, the dome returns to its initial non-collapsed position.

The bellows 514 are disposed over the stepped sections 546 of the retainer 512 using conventional techniques so that the bellows 514 are coupled to the stepped sections 546. The central compartment of the body 515 thus receives a portion of the stepped section 546 of the retainer 512 permitting the bellow 514 to be easily located and coupled to the retainer 512. The upper gasket 516 is disposed over the bellows 514 and further secures the bellows 514 within the overall structure. The upper gasket 516 has a pair of spaced openings 517 which receive the bellows 514 with a significant amount of the bellows 514 extending above the upper gasket 516 in the assembled, non-compressed position. The upper gasket 516 is disposed within the outer shell 520 so that it seats against and inner surface of the outer shell 520. The folds 566 of the bellows 514 preferably extend above the outer surface of the outer shell 520; however, the openings 522 of the outer shell 520 have a diameter which accommodates the bellow 514 and therefore the bellow 514 can be compressed and driven further into the opening 550 toward the circuit board 532.

The compression of the bellow 514 is caused by the bellow 514 compressing against the stepped section 546 of the retainer 512. This compression permits the lowermost tip 572 of the post 570 to be driven toward the circuit board 532 and more specifically, the bellow 514 compresses to a degree such that the lowermost tip 572 is driven into contact with the contact pad 534. This causes the contact pad 534 (dome) to collapse and the switch signal to be generated. Thus, in this embodiment, the switch assembly 510 is formed of a folded metal member which has spring-like characteristics permitting the bellow 514 to be compressed under force and then return to its initial, non-compressed position once the force is removed. The upper gasket 516 preferably provides a barrier preventing undesired material from entering the interior of the outer shell 520.

Because the bellow 514 is formed of a metal, the bellow 514 is puncture resistant to objects that are used in normal usage of the surgical handpiece and instruments (e.g., wire brushes) used in a normal cleaning operation (e.g., a sterilization process). The bellow 514 also provides a permeability barrier which prevents water vapor and gas transmission through the bellow 514. Therefore, the bellow 514 offers all of the advantages that were described hereinbefore with reference to earlier embodiments of switch members having permeability barriers formed therein.

It will be understood that while the previous embodiment has been described as including bellow elements 514, other types of depressable switch members may be used so long as the switch members freely move from a non-compressed position to a compressed position under an applied force and then self return to the non-compressed position once the applied force has been removed. For example, instead of having folds 556, the depressable and collapsible switch member may have a collapsible wall structure (e.g., see FIG. 11) which collapses under the applied force but returns to the non-compressed position once this applied force is removed. This may be metal switch member having a dome structure similar to that of FIG. 11 or it may include a different collapsible configuration.

Figure 16:
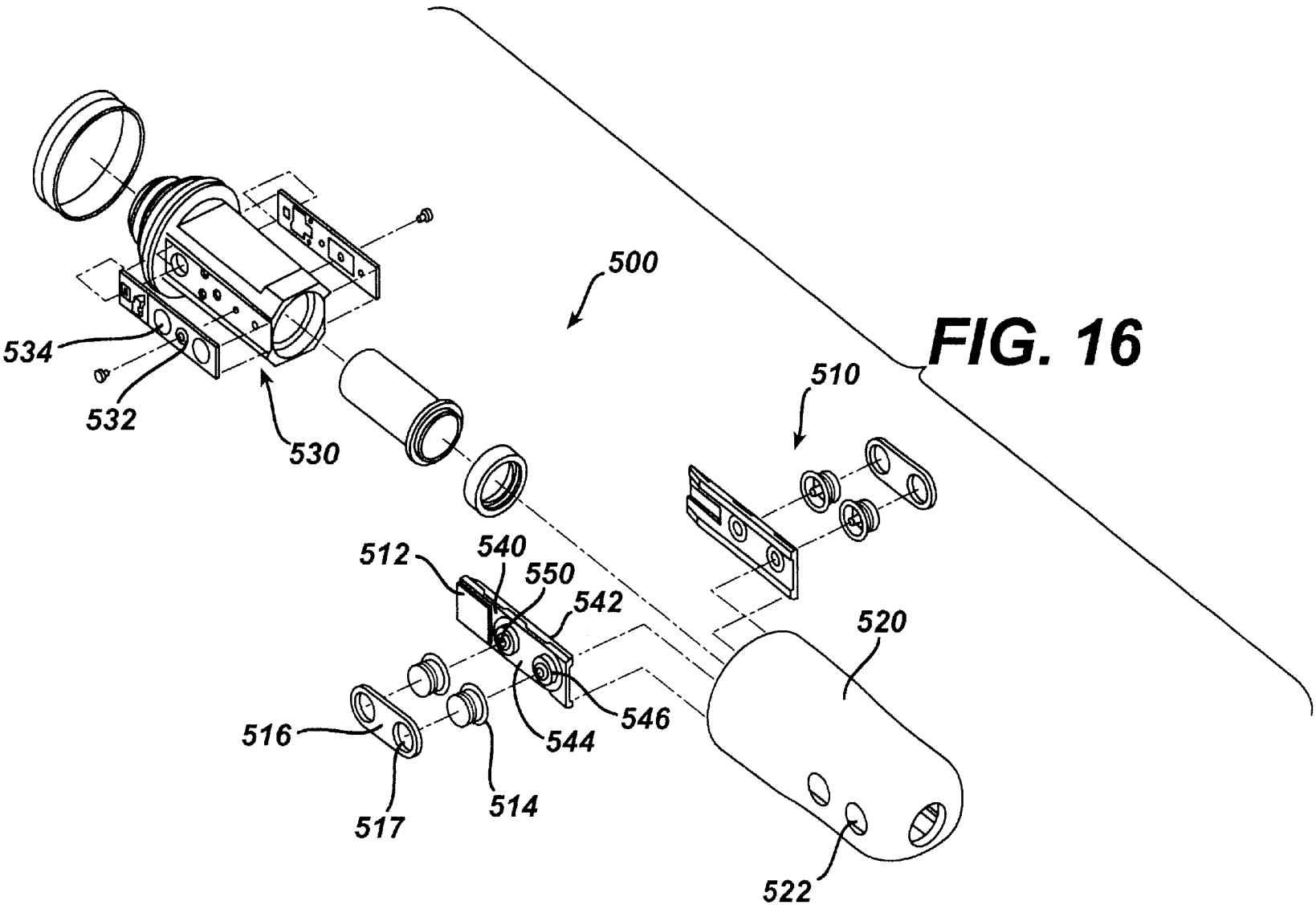
FIG. 16 is an exploded view of a switch end cap according to another exemplary embodiment.

FIG. 16 illustrates yet another embodiment which is similar to the embodiment shown in FIGS. 12–15. In this embodiment, the bellow 514 does not include a post 570 (FIG. 15). Instead, the bellow 514 has a hollow interior compartment and the portion of the bellow 514 which impinges the contact 534 of the circuit board 532 is actually an inner surface of the upper section 560 of the bellow 514.

The contact 534 is still preferably a collapsible contact (e.g., dome type configuration); however, a post 535 extends outwardly from the contact 534. The post 535 is similar to the post 570 (FIG. 15) in its dimensions and size as it is designed to be received in the opening 550 formed in the stepped section 546 of the retainer 512 when the retainer 512 is properly positioned over the circuit board 532. The post 535 thus extends through the opening 550 and extends at least partially into the interior compartment of the bellow 514. In the non-compressed position, the upper section 560 of the bellow 514 is spaced slightly above the top of the post 535. When a force is applied to the upper section 560, the body 515 of the bellow 514 compresses and the upper section 560 makes contact with the post 535. Because the post 535 is attached to a collapsible structure itself (the dome contact 534), the further application of force against the upper section 560 causes the post 535 to be driven downward. This results in the dome structure (contact 534) collapsing and the circuit being closed. A switch signal is then sent. Once the force is removed or the force becomes less, the upper section 560 moves outward as well as the post 535 as the dome structure 534 expands.

While the invention has been particularly shown and described with reference to the preferred embodiments thereof, it will be understood by those skilled in the art that various changes in form and detail may be made therein without departing from the spirit and scope of the invention.

What is claimed is:

1. A depressable switch member for use in a surgical handpiece to seal an interior of the handpiece, the switch member comprising:

a body having a pair of depressable sections and a skirt peripherally extending around the body, wherein an underside of the body includes a pair of protrusions extending outwardly therefrom and which form a part of the pair of the depressable sections; and a metallic layer disposed at least on surfaces of the pair of protrusions.

2. The switch member according to claim 1, wherein the metallic layer is disposed only on an underside of the skirt facing the interior of the handpiece.

3. The switch member according to claim 1, wherein the body is in the form of a rocker-type switch formed of an elastomer.

4. The switch member according to claim 1, wherein the metallic layer is disposed on an underside of both the body and the skirt.

5. The switch member according to claim 1, wherein the metallic layer is formed in an intermediate section of at least one of the body and the skirt between upper and lower surfaces thereof.

6. The switch member according to claim 1, wherein the peripheral skirt has a thickness less than a thickness of the body, the metallic layer being formed at least on an underside of the skirt.

7. A depressable switch member for use in a surgical handpiece to seal an interior of the handpiece, the switch member comprising:

a body and a skirt extending peripherally around the body; and a substrate disposed between at least one of the body and the skirt and the handpiece interior, wherein at least a portion of the substrate is covered with a permeability barrier, wherein the permeability barrier is a metallic barrier.

8. The switch member according to claim 7, wherein the substrate is integrally formed with at least one of the body and the skirt.

9. The switch member according to claim 7, wherein the substrate is spaced from an underside of the body and the skirt.

10. The switch member according to claim 7, wherein the metallic layer is a metallic coating having a thickness between about $5\mu$ inch and about 0.005 inch.

11. The switch member according to claim 7, wherein the substrate is disposed immediately adjacent at least one of the body and the skirt.

12. A depressable switch member for use in a surgical handpiece to seal an interior of the handpiece, the switch member comprising:

a body and a skirt extending peripherally around the body; and a substrate disposed between at least one of the body and the skirt and the handpiece interior, wherein at least a portion of the substrate is covered with a permeability barrier, wherein the permeability barrier comprises a polymeric layer which has been structurally altered resulting in reduced porosity of the polymeric layer.

13. The switch member according to claim 12, wherein the permeability barrier comprises a layer which has been altered so that it contains three dimensional cross-linked polymer chains.

14. A depressable switch member for use in a surgical handpiece to seal an interior of the handpiece, the switch member comprising:

a body and a skirt extending peripherally around the body; and a substrate disposed between at least one of the body and the skirt and the handpiece interior, wherein at least a portion of the substrate is covered with a permeability barrier, wherein the permeability barrier comprises a petroleum layer applied to an underside surface of the body.

15. The switch member according to claim 14, wherein the petroleum layer is formed of one of an oil layer and a grease layer.

16. The switch member according to claim 14, further including:

a laminate disposed against the petroleum layer so that the petroleum layer is disposed between at least one of the body and the skirt and the laminate, the laminate preventing migration of the petroleum layer.

17. A depressable switch member for use in a surgical handpiece to seal an interior of the handpiece, the switch member comprising:

a body and a skirt extending peripherally around the body; and a substrate disposed between at least one of the body and the skirt and the handpiece interior, wherein at least a portion of the substrate is covered with a permeability barrier, wherein the permeability barrier is a ceramic layer.

18. A depressable switch member for use in a surgical handpiece to seal an interior of the handpiece, the switch member comprising:

a body and a skirt peripherally extending around the body; and a permeability barrier disposed within at least one of the body and the skirt for reducing a fluid transmission rate therethrough, wherein the permeability barrier comprises a plurality of microspheres disposed throughout at least the skirt.

19. The switch member according to claim 18, wherein the plurality of microspheres is disposed through the body and the skirt.

20. The switch member according to claim 19, wherein the microspheres comprise one of hollow members and solid members.

21. A depressable switch member for use in a surgical handpiece to seal an interior of the handpiece, the switch member comprising:

a body and a skirt peripherally extending around the body; and a permeability barrier disposed within at least one of the body and the skirt for reducing a fluid transmission rate therethrough, wherein the permeability barrier comprises a plurality of fibers disposed through the body.

22. The switch member according to claim 21, wherein the fibers are formed of a material selected from the group consisting of quartz, ceramic, and carbon.

23. A vent assembly for use in a surgical handpiece for sealing an interior of the handpiece while permitting pressure equalization between the interior and exterior, the vent assembly comprising:

a vent formed in an outer shell of the handpiece, the vent being in communication with the handpiece interior; and a hydrophobic membrane disposed over the vent, the hydrophobic membrane permitting gases to flow into and out of the interior through the vent while preventing liquids from entering the interior through the vent.

24. The vent assembly according to claim 23, wherein the hydrophobic membrane comprises a microporous hydrophobic membrane formed of a material selected from the group consisting of polytetrafluoroethylene and polypropylene.

25. The vent assembly according to claim 23, wherein the vent is formed in a location that is not accessible to a user of the handpiece.

26. A method of reducing the fluid transmission rate of an elastomeric switch member for use in a switch assembly, the method comprising:

subjecting the elastomeric member to a surface treatment for a sufficient period of time such that the porosity of at least a portion of the elastomeric member is decreased resulting in a reduction of the fluid transmission rate of the elastomeric member.

27. The method according to claim 26, wherein the surface treatment includes:

placing the elastomeric member in a cryogenic environment for the sufficient period of time resulting in the decrease in porosity.

28. The method according to claim 26, wherein the surface treatment includes:

subjecting a surface of the elastomeric member to an ion implantation process, whereby the lower surface is structurally modified resulting in decreased porosity.

29. The method according to claim 26, wherein the surface treatment includes:

subjecting a surface of the elastomeric member to a laser sintering process, whereby the lower surface is structurally modified.

30. A method of venting gases from an interior cavity of a surgical handpiece while preventing liquids from entering the interior cavity, the method comprising:

forming a vent opening within an outer shell of the handpiece, the vent opening communicating with the interior cavity; and disposing a hydrophobic membrane over the vent opening, the hydrophobic membrane permitting gases to enter and exit the interior cavity through the vent opening while preventing liquids from entering the interior cavity through the vent opening.

31. The method according to claim 30, wherein the vent opening is formed in a location that is not accessible to a user of the handpiece.

32. The method according to claim 30, wherein the hydrophobic membrane comprises a microporous membrane formed of a material selected from the group consisting of polytetrafluoroethyelene and polypropylene.

33. A switch assembly for use in a surgical handpiece to seal an interior of a handpiece outer shell, the switch assembly comprising:

a compressible switch member formed of a metal and including a body having a portion which is compressible between a first non-compressed position and a second compressed position under an application of a first force, the compression of the body portion generating a return force which is stored and then released once the first force is removed, the return force causing the body to return to the first non-compressed position, wherein the compressible switch member comprises a bellow switch member having a number of folds intermediate first and second end sections of the bellow for providing compression of the bellow under the first force, the compression of the folds generating toe return force, the first and second end sections being free of folds.

34. The switch assembly according to claim 33, further including:

a retainer having a first surface and a second surface, the first surface including a platform having a protruding member formed thereon, an opening being formed through the protruding member and extending through the retainer;

a gasket disposed over the retainer, the gasket having an opening for receiving the bellow; and wherein the bellow is disposed over and coupled to the protruding member, the bellow having a portion for contacting a contact of an electronic switch component.

35. The switch assembly according to claim 34, wherein the portion which contacts the contact is a post which is integrally formed with the bellow and extends through the opening of the protruding member.

36. The switch assembly according to claim 34, wherein the contact of the electronic switch component comprises a collapsible dome structure formed as part of a printed circuit board.

37. The switch assembly according to claim 34, wherein the retainer comprises a retainer plate and the protruding member comprises a pair of stacked concentric rings with the opening extending through the centers thereof.

38. The switch assembly according to claim 37, wherein the diameter of a lowermost ring is approximately equal to an inner diameter of a cavity formed in the bellow, the cavity receiving the protruding member so as to locate and couple the bellow to the retainer.

39. The switch assembly according to claim 38, wherein the post of the bellow extends through the cavity and is freely movable therein so that upon application of force to an upper section of the bellow, the post is directed downward and extends further beyond a lower end of the bellow.

40. The switch assembly according to claim 33, wherein the bellow is a generally annular body having a lower section and an upper section with the folds being formed in an intermediate section, the upper, lower, and intermediate sections having the same diameter, while the diameter of the body between the folds and between the folds and the upper and lower sections is reduced.

41. The switch assembly according to claim 34, further including:

a circuit board having a collapsible dome contact structure formed thereon, the collapsing of the dome causing a switch circuit of the circuit board to be closed resulting in a first switch signal being generated, the retainer being disposed above the circuit board so that the opening extending through the protruding member and the retainer is axially aligned with collapsible dome.

42. A switch member for use ion a surgical handpiece to seal an anterior of the handpiece, the switch member comprising:

a body and a skirt peripherally extending around the body, wherein at least first is formed of a material that is impermeable to fluids, wherein the skirt has a number of folds formed therein, wherein the skirt is formed of a polymeric material that has been surface treated so that a porosity of the polymeric layer is reduced.

* * * * *